US006918710B2

(12) United States Patent
Budds et al.

(10) Patent No.: US 6,918,710 B2
(45) Date of Patent: Jul. 19, 2005

(54) DISPOSABLE PACKAGE FOR A VOLATILE LIQUID

(75) Inventors: Kate Budds, Staines (GB); Mark Jarvis, Maidenhead (GB); Roland Stark, Bracknell (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/444,842

(22) Filed: Aug. 11, 2003

(65) Prior Publication Data

US 2004/0067090 A1 Apr. 8, 2004

Related U.S. Application Data

(63) Continuation of application No. PCT/US01/45034, filed on Nov. 30, 2001.

(51) Int. Cl.[7] ..... B43K 5/14

(52) U.S. Cl. ..... 401/132; 401/118; 222/80; 222/541.2

(58) Field of Search ..... 401/118, 132–135; 222/80, 81, 83, 541.1, 541; 604/3

(56) References Cited

U.S. PATENT DOCUMENTS

| | | | | | |
|---|---|---|---|---|---|
| 2,642,064 | A | * | 6/1953 | Lawshe | 604/192 |
| 3,580,423 | A | * | 5/1971 | Gilman | 222/81 |
| 3,802,604 | A | * | 4/1974 | Morane et al. | 222/83 |
| 4,507,111 | A | * | 3/1985 | Gordon et al. | 604/3 |
| 4,722,449 | A | * | 2/1988 | Dubach | 215/235 |
| 5,042,690 | A | * | 8/1991 | O'Meara | 222/83 |
| 5,120,301 | A | * | 6/1992 | Wu | 604/3 |
| 5,609,581 | A | * | 3/1997 | Fletcher et al. | 604/212 |
| 5,769,552 | A | * | 6/1998 | Kelley et al. | 401/132 |
| 6,517,350 | B2 | * | 2/2003 | Diasti et al. | 433/215 |

FOREIGN PATENT DOCUMENTS

| | | |
|---|---|---|
| WO | WO 98/53789 A1 | 12/1998 |
| WO | WO 00/41588 A3 | 7/2000 |
| WO | WO 00/41588 A2 | 7/2000 |
| WO | WO 01/01940 A1 | 1/2001 |

* cited by examiner

*Primary Examiner*—Justine R. Yu
*Assistant Examiner*—Huyen Le
(74) *Attorney, Agent, or Firm*—Emelyn DeLeon Hiland

(57) ABSTRACT

An improved package, suitable for holding a treatment fluid comprising a volatile solvent and kits comprising the package containing the treatment fluid and an applicator are disclosed. The package comprises a reservoir for the liquid which is sealed by a ruturable seal. A cap, coupled to one end of the reservoir, is in the form of a sleeve which is axially translatable along the reservoir from first to second positions. A cutting tool integrated with the cap ruptures the rupturable seal as the cap is moved from first to second positions so that the liquid can thereby be made accessible through an opening in an end wall of the cap. The package provides excellent protection for volatile liquids, yet can be easily opened by a simple press-action, instantly providing access to the liquid so that it can subsequently accessed by a liquid applicator.

10 Claims, 3 Drawing Sheets

DISPOSABLE PACKAGE FOR A VOLATILE LIQUID

CROSS REFERENCE

This is a continuation of International Application Serial No. PCT/US01/45034, filed Nov. 30, 2001, which claims priority to UK Application 0029354.8, filed Dec. 1, 2000.

FIELD OF THE INVENTION

The present invention relates to a disposable package for a liquid, in particular for a volatile, film-forming liquid that can be used for treatment of the teeth.

BACKGROUND OF THE INVENTION

There is a growing demand for people to be able to treat their own teeth, for example with tooth whitening products, beyond the traditional brushing with a cleansing product. An exemplary tooth whitening composition is disclosed in PCT application WO 01/01940, incorporated herein by reference.

The treatment fluid disclosed in the above-referenced PCT application is but one example of a number of useful fluid compositions which comprise a film-forming polymer dissolved or dispersed in a volatile solvent which can then be applied, e.g. by painting onto a surface to be treated. One of the problems posed by such fluids is the need to provide a convenient package that prevents the fluid from drying out yet is convenient to use when needed.

It is an object of the present invention, therefore, to provide a disposable package for a volatile, film-forming liquid. It is a further object of the present invention to provide a sealed package for a liquid, which package is easy to open and use. It is yet a further object of the present invention to provide a package that is economical to manufacture.

These and other objectives will become readily apparent from the detailed description that follows.

Sealed ampoules for liquid are known from e.g. German utility model DE 92 02 654 U1 which discloses an ampoule which can be snapped open to allow a brush to be inserted.

WO 98/53789 describes a multichamber ampoule having first and second cylindrical cases that fit into each other coaxially and are telescopic.

WO 00/41588 describes a self-cleaning dip-in package for liquids which comprise volatile solvents and film-forming resins.

The present invention provides a package comprising a reservoir for the liquid which is sealed by a rupturable seal. A cap, coupled to one end of the reservoir, is the form of a sleeve which is coaxially translatable along the reservoir from first to second positions. A cutting tool integrated with the cap ruptures the rupturable seal as the cap is moved from first to second positions so that the liquid can thereby be made accessible through an opening in an end wall of the cap.

SUMMARY OF THE INVENTION

The present invention provides a package for a liquid, the package comprising:

a) a reservoir for the liquid comprising a side wall, having an outer surface, and first and second ends disposed at opposite ends of a longitudinal axis of the reservoir, the first end defining an opening sealed by a rupturable seal and the second end being sealed; and b) a cap, in the form of a sleeve, coaxially coupled to the first end of the reservoir and having a longitudinal axis common with that of the reservoir, the cap being axially translatable along the longitudinal axis of the reservoir from first to second positions and comprising:

(i) a side wall having an inner surface which is frictionally engageable with the outer surface of the reservoir side wall;

(ii) first and second ends defined by the side wall of the cap, the first end being engaged over the first end of the reservoir in both first and second positions, the second end comprising a cap end wall which abuts against the reservoir in the second position, the cap end wall including an opening through which liquid in the reservoir can be accessed when its rupturable seal is ruptured; and (iii) a cutting tool depending from the cap end wall so that when the cap is axially translated from the first to the second position, the cutting tool ruptures the rupturable seal so that the liquid can thereby be made accessible through the opening of the cap end wall.

The package design disclosed herein provides excellent protection for volatile liquids, yet can be easily opened by a simple press-action, instantly providing access to the liquid so that it can subsequently accessed by a liquid applicator.

The invention further relates to kits comprising the package and an applicator and/or treatment fluid.

DESCRIPTION OF PREFERRED EMBODIMENTS

Figure 1:
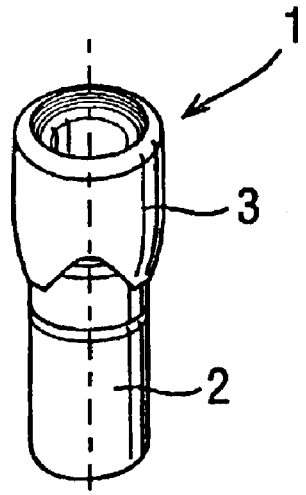
FIG. 1 is a perspective view of a package according to this invention, illustrated at close to actual size and showing the longitudinal axis thereof.

The present invention is now described in detail by way of an embodiment thereof with reference to the accompanying drawings.

The package 1, is generally cylindrical and comprises a reservoir 2, for a liquid, and cap 3. The reservoir and cap are preferably made out of a resilient, food contact approved (FDA) grade of plastic by injection moulding. Other materials such as aluminium can also be used. Suitable plastics include COC, polypropylene, polyethylene, nylon, polyacetal, acrylonitrile materials such as Barex®, and polycarbonate. Preferred is polypropylene.

Reservoir 2 comprises a side wall 4, having an outer surface, and first and second ends, 5 and 6, disposed at opposite ends of the reservoir, the first end defining an opening sealed by a rupturable seal 7 and the second end being sealed. The cross-section of the package perpendicular to the longitudinal axis, though circular in this embodiment, is not critical and could, for example be square, triangular or oval. The seal is preferably made of a monolayer of aluminium foil, though laminates could also be used. Foil seals are coated with a lacquer on one side to enable heat sealing to the reservoir. The seal thickness is preferably in the range from about 15 to about 50 $\mu$m, more preferably about 20 $\mu$m. The seal is attached to the first end of the reservoir, after filling with the desired liquid, completely closing the reservoir opening. It is preferably attached by heat-sealing, for example by conductive or inductive heating. The outer surface of the reservoir side wall comprises a first groove 8 and second groove 9 which define first and second positions on the reservoir.

The package cap 3 is in the form of a sleeve which has a longitudinal axis common with that of the reservoir and has a cross-section matched to that of the reservoir, circular in this instance. The cap comprises a side wall 10 having an inner surface 11 which is frictionally engageable with the outer surface 4 of the reservoir side wall and axially translatable along the longitudinal axis of the reservoir from first to second positions.

Figure 4:
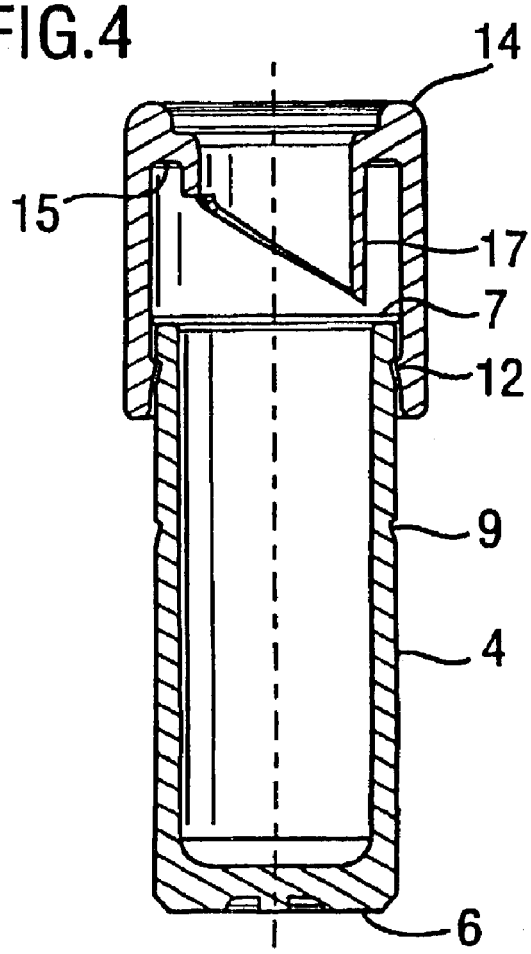
FIG. 4 is a partial, longitudinal cross-section through the package in its first position, as assembled.
Figure 5:
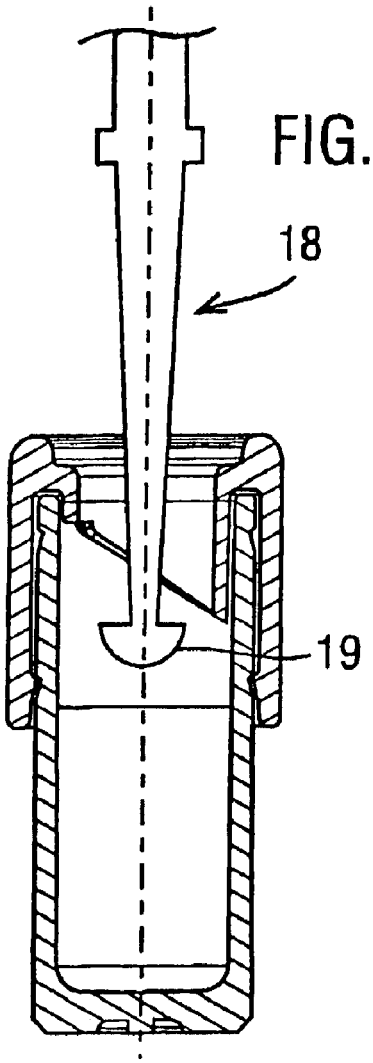
FIG. 5 is a partial, longitudinal cross-section through the package in its second position, after the seal has been ruptured, allowing access to a liquid in the package (not shown) by an applicator (shown in part)
Figure 6:
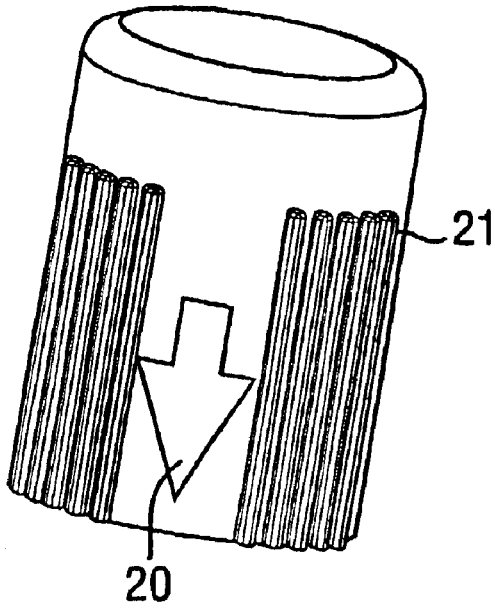
FIG. 6 is a perspective view of an alternate embodiment of the cap.

The inner surface of the cap side wall comprises lugs 12 which provide the frictional engagement with the outer surface 4 of the reservoir side wall. The lugs engage with the first groove in the first position and yet allow the cap to be translated to the second position on the reservoir. They are ramped, as best seen in FIGS. 4 and 5, better to resist the cap being removed once assembled. The grooves and lugs in combination form detents which both secure the cap to the reservoir and provide feedback to a user of the package on the correct location of the first and second positions. The lugs can be spaced apart around the inner surface of the cap side wall or form a continuous ring. In the embodiment shown, there are four lugs located at 90° intervals on downwardly projecting scalloped edges of the lower (second) end of the cap. Locating the lugs on these projections assists in allowing the lugs to be pushed outwardly as the cap is assembled onto the reservoir. The remainder of the cap is dimensioned to allow a small clearance, say about 0.1 mm between the cap inner surface and the outer surface of the reservoir side wall so that the fit of the cap is not too tight. This clearance should not be excessive other wise the stability of the cap on the reservoir might be compromised. Likewise the co-operating lugs and grooves should be positioned to provide for a substantial overlap of the reservoir and cap in its assembled, first position in order to provide cap stability.

Figure 2:
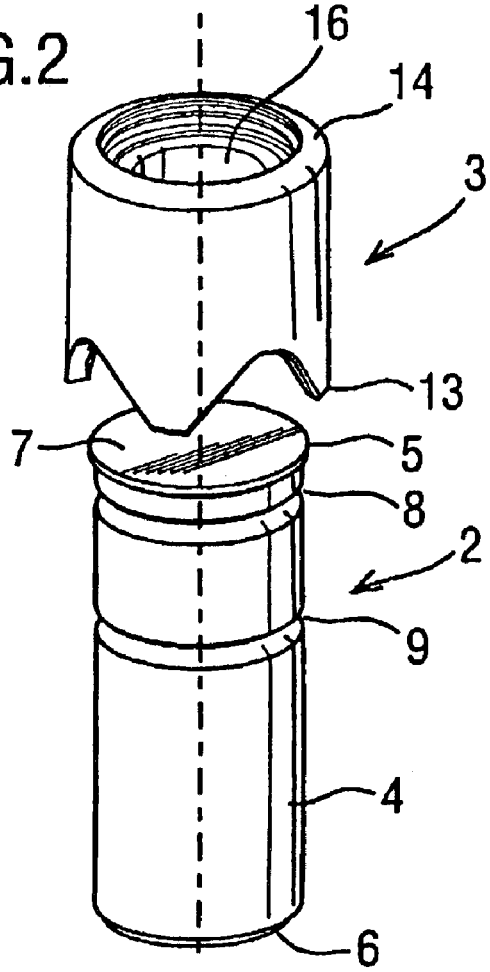
FIG. 2 is an exploded view more clearly showing the reservoir and cap.
Figure 3:
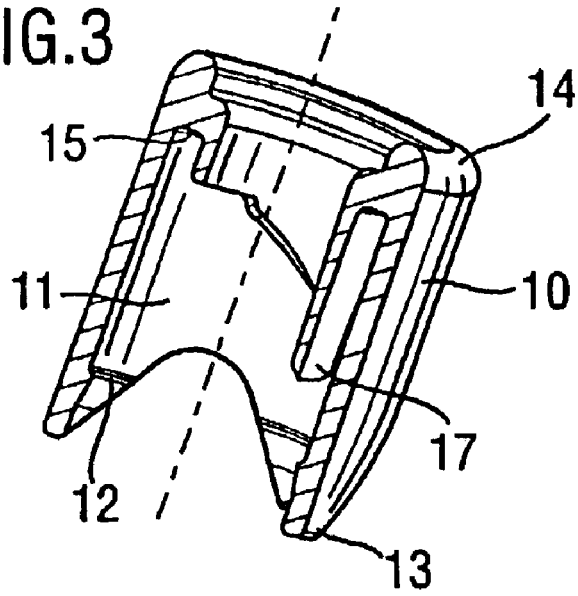
FIG. 3 is a partial, longitudinal cross-section through the cap showing the cutting tool.

The cap further includes first and second ends, 13 and 14, defined by the side wall of the cap. The first end of the cap is engaged over the first end of the reservoir in both first and second positions and has a scalloped profile as discussed above and as best seen in FIG. 2. The second end of the cap comprises a cap end wall 15 which abuts against the first end of the reservoir in the second position. The cap end wall includes an opening 16 through which liquid in the reservoir 2 can be accessed when its rupturable seal 7 is ruptured.

A cutting tool 17, in the form of a knife integrally moulded with the cap end wall, depends from the cap end wall 15. When the sleeve is axially translated from the first to the second position, the cutting tool ruptures the rupturable seal so that the liquid can thereby be made accessible through the opening 16 of the cap end wall. The cutting tool forms a sloping part section of a cylinder, as best seen in FIG. 4, thus when the tool cuts through the rupturable seal it also pushes the seal aside allowing easy access to liquid in the package. Although a variety of shapes for the cutting tool are possible, to provide a clean cut and a smooth opening it is preferred that the tool is shaped so that as the cap is advanced from first to second positions, only one point on the cutting edge is cutting the seal at any point in time. The cutting tool described in this embodiment has the further advantage that as the seal is cut it is tucked away behind the cutting tool, preventing it from subsequently interfering with the applicator.

It can be seen from the foregoing that the package comprises only two distinct parts, cap and reservoir, each of which can be readily moulded and which are easily assembled by pushing the cap onto the reservoir. If required the reservoir can have a lip at its first end to co-operate with a ramp on the cap in order to resist the cap being pulled off once the package is assembled. In its assembled state a simple push action is sufficient to move the cap to the second position on the reservoir, thereby rupturing the seal. The package is cheap enough to be discarded once used. A preferred method of accessing the liquid is by means of an applicator 18 which can be included with the package in a kit. The applicator will generally comprise an applicator tip 19 which is can be, for example, a brush, a flocked applicator or a sponge. Preferably the applicator tip is a nylon brush.

The cap 3 may further include indicia 20 on an outer surface of its side wall, to indicate to a user of the package that the cap is intended to be translated from first to second positions, and projections, such as longitudinal ribs 21 to assist in gripping the cap. Such ribbing could also include transverse ribbing.

Figure 7:
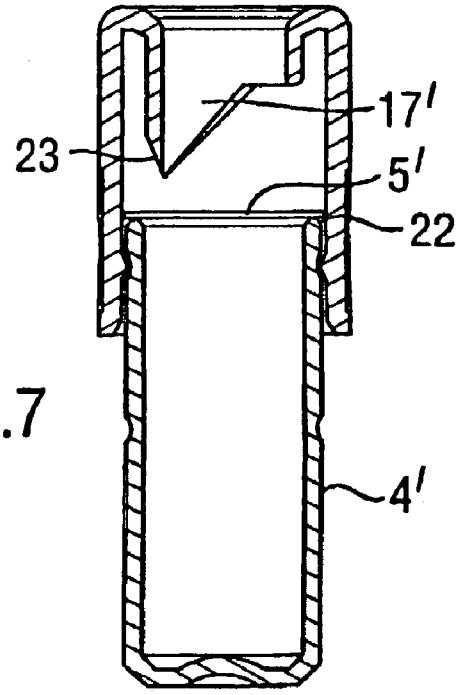
FIG. 7 is a partial, longitudinal cross-section through a further embodiment of the package showing a modified cutting tool and reservoir side walls.

FIG. 7 illustrates a preferred further embodiment with features that assist in reliable manufacture and opening of the package. In the embodiment of FIG. 7, the reservoir side wall 4' has a chamfer 22 at inner and outer surfaces of the first end 5' of the reservoir. This ensures that when the rupturable seal is sealed to the first end of the reservoir, that local melting of the reservoir side wall does not result in beads which extend beyond the side wall and interfere with the fit of the cap. Further, the cutting tool 17' also has a chamfer 23 at a lower end of the tool which assists opening of the package. As the cap is depressed towards its second position chamfer 23 ensures that cutting tool 17' is guided past reservoir side wall 4' and does not interfere with the cap movement by abutting against the first end of the reservoir side wall thereby preventing further translation of the cap.

The package may be provided as part of a kit which includes the package, and one, or preferably both of a liquid treatment composition, preferably a tooth whitening composition, and an applicator for the composition, such as a brush, optionally together with instructions for use. The treatment composition can be purely cosmetic, such as a lip cosmetic or mascara, or it can be a therapeutic composition, such as a remineralising composition for strengthening tooth enamel or an anticaries or desensitising tooth treatment. Preferably the liquid treatment composition comprises an organic solvent having a boiling point of less than 200° C. A preferred liquid treatment composition is a tooth whitening composition further comprising a bleaching agent. Exemplary cosmetic treatments, in particular tooth whitening compositions, are provided in PCT application WO 01/01940, incorporated herein by reference.

The packages of the invention are intended to be disposable items and are therefore generally small in nature. The embodiments illustrated have a total reservoir volume of about 0.6 ml, and are normally charged with about 0.3 ml treatment composition. Actual dimensions should of course be chosen to suit the particular purpose. Where the amount of liquid composition to be applied in a single application is relatively large, or where the composition can be stored after opening without significant deterioration, for example in the case of non-volatile solvents, then it may be appropriate of rather larger dimensions to be employed, such as up to 10 ml or even 100 ml.

Since the invention disclosed herein may be embodied in other specific forms without departing from the general characteristics, the embodiment described herein is, therefore, to be considered in all respects as merely illustrative, the scope of the invention being indicated by the appended claims, rather than by the foregoing description; and all embodiments which come within the meaning and range of equivalency of the claims are therefore intended to be embraced therein. For example, in the embodiment described, the cap translates linearly along the reservoir. The cap, could however be threaded onto the reservoir so that the translation is of a rotary nature. Likewise the cap could incorporate means to attach an applicator, for example in the manner of WO 98/53789.

What is claimed is:

1. A package for a liquid, the package comprising:

a) a reservoir for the liquid comprising a side wall, having an outer surface, and first and second ends disposed at opposite ends of a longitudinal axis of the reservoir, the first end defining an opening sealed by a rupturable seal and the second end being scaled; and b) a cap, in the form of a sleeve, coaxially coupled to the first end of the reservoir and having a longitudinal axis common with that of the reservoir, the cap being axially translatable along the longitudinal axis of the reservoir from first to second positions and comprising:

(i) a side wall having an inner surface which is frictionally engageable with the outer surface of the reservoir side wall;

(ii) first and second ends defined by the side wall of the cap, the first end being engaged over the first end of the reservoir in both first and second positions, the second end comprising a cap end wall which abuts against the reservoir in the second position, the cap end wall including an opening through which liquid in the reservoir can be accessed when its rupturable seal is ruptured; and (iii) a cutting tool depending from the cap end wall so that when the cap is axially translated from the first to the second position, the cutting tool ruptures the rupturable seal so that the liquid can thereby be made accessible through the opening of the cap end wall.

wherein a separate applicator is insertable through the opening of the cap end wall when the package is in its second position to access the liquid composition.

2. A package according to claim 1, wherein the reservoir and cap have circular cross-sections perpendicular to the longitudinal axis.

3. A package according to claim 1, wherein the outer surface of the reservoir side wall comprises a first groove and the inner surface of the cap side wall comprises lugs which engage with the first groove in the first position.

4. A package according to claim 3, wherein the outer surface of the reservoir side wall comprises a second groove and the lugs engage with the second groove in the second position.

5. A package according to claim 1, wherein the cutting tool is a knife integrally moulded with the cap end wall, wherein the cutting tool has a chamfer a lower end thereof in order to prevent interference with the reservoir side wall.

6. A package according to claim 1, further comprising a liquid treatment composition sealed within the reservoir, the treatment composition comprising an organic solvent having a boiling point of less than 200° C.

7. A package according to claim 6, wherein the liquid treatment composition is a tooth whitening composition further comprising a bleaching agent.

8. A kit comprising:

a) a package comprising;

(i) a reservoir for the liquid comprising a side wall having an outer surface, and first and second ends disposed at opposite ends of a longitudinal axis of the reservoir, the first end defining an opening sealed by a rupturable seal and the second end being sealed; and (ii) a cap, in the form of a sleeve, coaxially coupled to the first end of the reservoir and having a longitudinal axis common with that of the reservoir, the cap being axially translatable along the longitudinal axis of the reservoir from first to second positions and comprising:

(a) a side wall having an inner surface which is frictionally engageable with the outer surface of the reservoir side wall;

(b) first and second ends defined by the side wall of the cap, the first end being engaged over the first end of the reservoir in both first and second positions, the second end comprising a cap end wall which abuts against the reservoir in the second position, the cap end wall including an opening through which liquid in the reservoir can be accessed when its rupturable seal is ruptured; and (c) a cutting tool depending from the cap end wall so that when the cap is axially translated from the first to the second position, the cutting tool ruptures the rupturable seal so that the liquid can thereby be made accessible through the opening of the cap end wall;

b) a liquid treatment composition sealed within the reservoir, the treatment composition comprising an organic solvent having a boiling point of less than 200° C.; and c) an applicator for the liquid treatment composition, the applicator being insertable into the liquid treatment composition through the opening of the cap end wall when the package is in its second position.

9. A kit according to claim 8, wherein the liquid treatment composition is a tooth whitening composition further comprising a bleaching agent.

10. A kit according to claim 8, wherein the applicator has an applicator tip which is a nylon brush.

* * * * *